US011246469B2

(12) United States Patent
Jung et al.

(10) Patent No.: US 11,246,469 B2
(45) Date of Patent: Feb. 15, 2022

(54) DISH WASHER

(71) Applicant: LG Electronics Inc., Seoul (KR)

(72) Inventors: Changyoon Jung, Seoul (KR); Sangheon Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 120 days.

(21) Appl. No.: 16/697,784

(22) Filed: Nov. 27, 2019

(65) Prior Publication Data

US 2020/0163524 A1 May 28, 2020

(30) Foreign Application Priority Data

Nov. 27, 2018 (KR) ..... 10-2018-0148955

(51) Int. Cl.
*A47L 15/22* (2006.01)
*A47L 15/42* (2006.01)
*A47L 15/48* (2006.01)

(52) U.S. Cl.
CPC ..... *A47L 15/4278* (2013.01); *A47L 15/22* (2013.01); *A47L 15/4219* (2013.01); *A47L 15/4287* (2013.01); *A47L 15/4291* (2013.01); *A47L 15/483* (2013.01)

(58) Field of Classification Search
CPC .. A47L 15/22; A47L 15/4219; A47L 15/4278; A47L 15/4287; A47L 15/4291; A47L 15/483
USPC ..... 134/56 D, 57 D, 58 D, 107
See application file for complete search history.

(56) References Cited

U.S. PATENT DOCUMENTS

2015/0257627 A1* 9/2015 Park ..... A47L 15/483 34/72

FOREIGN PATENT DOCUMENTS

KR 20150108188 9/2015

* cited by examiner

*Primary Examiner* — Levon J Shahinian
(74) *Attorney, Agent, or Firm* — Fish & Richardson P.C.

(57) ABSTRACT

A dish washer includes: a washing tank having an accommodation space for storing dishes therein; an injection arm disposed inside the washing tank, and provided with a plurality of nozzles to selectively inject washing water and air to the dishes according to a washing stroke and a drying stroke; a duct unit that defines a passage for delivering the air to the injection arm; a suction fan provided inside the duct unit to suction the air and supply the air to the injection arm; and an air heating element that heats the air to be supplied to the injection arm.

20 Claims, 10 Drawing Sheets

DISH WASHER

CROSS-REFERENCE TO RELATED APPLICATION

Pursuant to 35 U.S.C. § 119(a), this application claims the benefit of an earlier filing date of and the right of priority to Korean Patent Application No. 10-2018-0148955, filed on Nov. 27, 2018, the contents of which are incorporated by reference herein in its entirety.

BACKGROUND

1. Technical Field

The present disclosure relates to a dish washer that heats washing water using a heat pump.

2. Description of the Related Art

A dish washer is a device that automatically washes and dries dishes using detergent or the like.

The dish washer may be configured to perform a process of washing, rinsing and drying dishes placed inside a main body thereof.

The dish washer may heat washing water or air using an electric heater provided in the main body.

However, the electric heater used in the dish washer has a problem that consumes a lot of power when washing and drying dishes.

In order to solve the foregoing problems, a dish washer capable of reducing energy consumption by heating washing water or air using a heat pump has been developed.

Prior art document KR 10-2015-0108188 A (published Sep. 25, 2015) discloses a household appliance (dish washer) having a drying device. The dish washer in the prior art includes a heat pump system that suctions air through a suction port at an upper portion of a washing tank to heat the suctioned air using heat discharged from a condenser, and dries dishes by discharging the heated hot air into the washing tank through the discharge port disposed at a lower side of the washing tank.

However, the dish washer in the prior at dries dishes while hot air discharged into the inside of the washing tank moves from the discharge port of the washing tank to the suction port by natural convection, and thus there is a problem that the drying time is prolonged.

In addition, an additional fan for actively generating an air flow is not provided in the washing tank, and there is a limit in more quickly transferring the heat of hot air to dishes.

SUMMARY

The present disclosure has been made to solve the problems in the related art, an aspect of the present disclosure is to provide a dish washer capable of directly injecting hot air into dishes through a nozzle of an injection arm to improve the drying performance of the dishes.

Furthermore, another aspect of the present disclosure is to provide a dish washer provided with an air injection nozzle in addition to a washing water injection nozzle in the injection arm, in which a hole size of the air injection nozzle is larger than that of the washing water injection nozzle, to increase a flow rate of hot air to be supplied to dishes, thereby improving the drying performance.

In addition, still another aspect of the present disclosure is to provide a dish washer provided with a nozzle opening and closing portion in the injection arm, wherein the washing water injection nozzle and the air injection nozzle can be selectively opened and closed according to the washing stroke and the drying stroke.

Moreover, yet still another aspect of the present disclosure is to provide a dish washer capable of rotating the injection arm by an injection pressure of air even without the power of a motor to actively generate an air flow so as to improve the drying performance by the air flow, thereby reducing the drying time.

In order to achieve the foregoing objectives, a dish washer according to an example of the present disclosure may include a washing tank having an accommodation space for storing dishes therein; an injection arm disposed inside the washing tank, and provided with a plurality of nozzles to selectively inject washing water and air to the dishes according to a washing stroke and a drying stroke; a duct unit that defines a passage for delivering the air to the injection arm; a suction fan provided inside the duct unit to suction the air and supply the air to the injection arm; and an air heating element that heats the air to be supplied to the injection arm.

According to an example associated with the present disclosure, the plurality of nozzles may have different hole sizes according to the washing water or air.

According to an example associated with the present disclosure, the plurality of nozzles may include a plurality of first nozzles that inject the washing water during the washing stroke; and a plurality of second nozzles that inject the air during the drying stroke.

According to an example associated with the present disclosure, the plurality of second nozzles may have a larger hole size than that of the plurality of first nozzles.

According to an example associated with the present disclosure, the plurality of first nozzles and the plurality of second nozzles may be alternately arranged along a length direction of the injection arm.

According to an example associated with the present disclosure, the dish washer may further include a circulation passage that transfers the washing water to the injection arm; and an air delivery passage that connects the duct unit and the circulation passage to deliver the air to the injection arm.

According to an example associated with the present disclosure, the dish washer may further include a non-return valve provided at a connection portion between the circulation passage and the air delivery passage.

According to an example associated with the present disclosure, the injection arm may include an injection arm body having the plurality of nozzles; a nozzle opening and closing portion provided with a plurality of nozzle communication holes and movably mounted inside the injection arm body to selectively connect the plurality of nozzles and the plurality of nozzle communication holes; a drive unit that drives the nozzle opening and closing portion; and a power transmission unit that transmits power received from the drive unit to the nozzle opening and closing portion.

According to an example associated with the present disclosure, the power transmission unit may include a drive gear portion connected to the drive unit to receive the power of the drive unit so as to transmit power to the nozzle opening and closing portion; and a linear guide provided at one side of the nozzle opening and closing portion, one side of which is provided with a rack gear to be tooth-coupled with the drive gear portion so as to move the nozzle opening and closing portion according to the rotation of the drive gear portion to selectively overlap the nozzle communication holes with the nozzles in a thickness direction.

According to an example associated with the present disclosure, the nozzle opening and closing portion selectively may open and close the first nozzles and the second nozzles according to the washing stroke and the drying stroke.

According to an example associated with the present disclosure, the injection arm may include a plurality of first injection arm portions having the plurality of first nozzles spaced apart in a length direction and a first inner passage communicating with the plurality of first nozzles; a plurality of second injection arm portions having the plurality of second nozzles spaced apart in a length direction and a second internal passage communicating with the plurality of second nozzles; and a central connection portion connecting the inner end portions of the plurality of first injection arm portions and the plurality of second injection arm portions to communicate with each other.

According to an example associated with the present disclosure, the dish washer may further include an injection arm connection pipe, one side of which is connected in communication with a central portion of the injection arm, and the other side of which is connected in communication with the circulation passage, wherein the washing water or the air moves from the circulation passage to the injection arm through the injection arm connection pipe.

According to an example associated with the present disclosure, a plurality of the injection arms may be arranged to be spaced apart from each other inside washing tank in a vertical direction.

According to an example associated with the present disclosure, each of the plurality of injection arms may be rotatably mounted, and rotated by an injection pressure of the washing water or the air.

According to an example associated with the present disclosure, the air heating element may be a heat pump system, and the heat pump system may include a compressor that circulates refrigerant; a condenser provided inside the duct unit to discharge the heat of the refrigerant compressed in the compressor to the air; an expansion apparatus that expands refrigerant condensed in the condenser; and an evaporator that evaporates refrigerant received from the expansion apparatus to transfer the refrigerant to the compressor.

According to another example associated with the present disclosure, the air heating element may be an electric heater provided inside the duct unit.

According to still another example associated with the present disclosure, the air heating element may include a condenser provided inside the duct unit; and an electric heater provided inside the duct unit to further selectively heat air heated from the condenser.

According to an example associated with the present disclosure, the dish washer may further include a heat exchange chamber that accommodates the evaporator and stores water therein to exchange heat between the water and the evaporator.

According to an example associated with the present disclosure, the dish washer may further include a controller that controls the operation of the condenser, wherein the controller operates the heat pump system during a washing stroke to preheat the air prior to a drying stroke.

According to an example associated with the present disclosure, the dish washer may further include a suction port disposed at an upper portion of the washing tank to suction the air inside the washing tank; and an air circulation pipe that circulates the air from the suction port to a lower portion of the duct unit.

According to an example associated with the present disclosure, the duct unit may be disposed at an upper portion of the washing tank.

The effects of a dish washer having a heat pump according to the present disclosure will be described as follows.

First, a first nozzle for washing water and a second nozzle for air, which are arranged to have different hole sizes in an injection arm portion, may be selectively opened and closed according to the washing stroke and the drying stroke, thereby opening the first nozzle to inject washing water to dishes with the injection arm so as to wash the dishes during the washing stroke.

Second, the second nozzle may be opened to inject heated air to dishes through an injection arm to dry the dishes during the drying stroke.

Third, hot air may increase flow rate while passing through the air nozzle (second nozzle) having a larger hole size than the washing water nozzle (first nozzle), thereby improving the drying performance.

Fourth, as hot air passes through the injection arm, the flow rate may increase and hot air may be blown out to dishes at an increased injection pressure through the plurality of nozzles, thereby transferring more heat to the dishes more quickly than a drying method by natural convection inside a washing tank in the related art.

Fifth, as an air injection pressure of the nozzles increases, the injection arm may obtain momentum by a reaction force against injecting air, thereby rotating the injection arm without the need for a motor or the like.

Sixth, as the injection arm rotates, a flow of air may be generated inside the washing tank to maximize the heat exchange performance between dishes and hot air, thereby greatly reducing the drying time of the dishes.

Seventh, the injection arm may be rotated by momentum due to an injection pressure of air, and a flow rate of air injected through the injection holes of the nozzles may further increase by a rotational speed of the injection arm rather than an injection speed of air injected from the nozzles to actively generate an air flow inside the washing tank, thereby significantly improving the drying performance.

Eighth, each of the plurality of nozzles may be arranged to be twisted at a predetermined angle with respect to a tangential direction of the circumference along a rotation direction of the injection arm to inject air in a direction crossing the circumference in an oblique direction, and the plurality of nozzles respectively arranged at both end portions of the injection arm with respect to the center of the injection arm may inject air in opposite directions, thereby increasing a rotational force (torque) due to the injection pressure of the air to more actively generate an air flow.

Ninth, an inclination angle of the injection holes of the nozzles may increase in a vertical direction as the nozzles are arranged closer to the center of the injection arm, and the inclination angle of the injection holes of the nozzles may decrease in a horizontal direction as the nozzles are arranged away from the center of the injection arm thereby improving the heat transfer efficiency due to an air flow as well as increasing an amount of air injected to dishes to reduce the drying time.

DETAILED DESCRIPTION OF THE EMBODIMENTS

Figure 1:
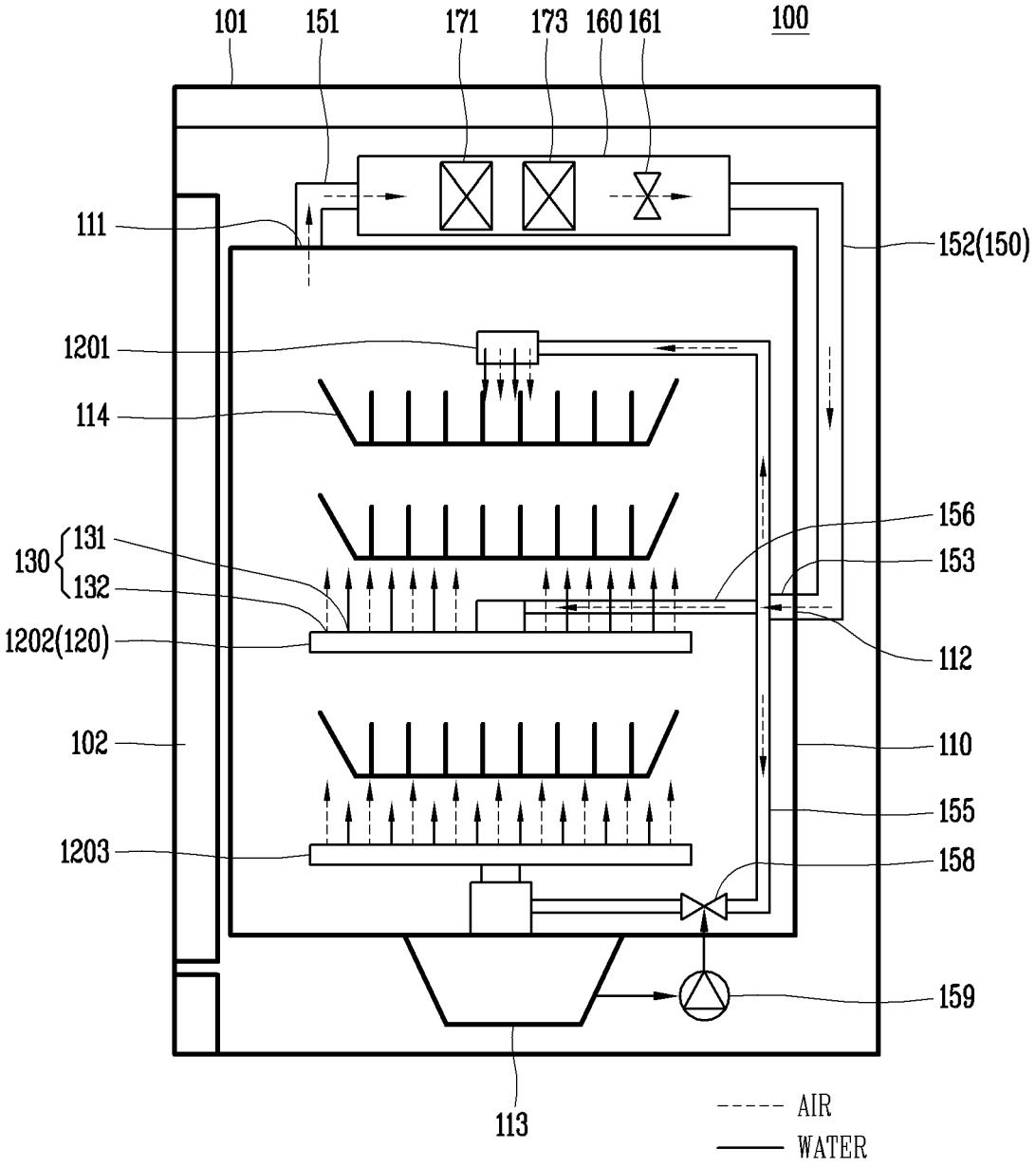
FIG. 1 is a conceptual view showing a dish washer according to a first embodiment of the present disclosure.

Hereinafter, the embodiments disclosed herein will be described in detail with reference to the accompanying drawings, and the same or similar elements are designated with the same numeral references regardless of the numerals in the drawings and their redundant description will be omitted. A suffix "module" and "unit" used for constituent elements disclosed in the following description is merely intended for easy description of the specification, and the suffix itself does not give any special meaning or function. In describing the embodiments disclosed herein, moreover, the detailed description will be omitted when specific description for publicly known technologies to which the invention pertains is judged to obscure the gist of the present disclosure. Also, it should be understood that the accompanying drawings are merely illustrated to easily explain the concept of the invention, and therefore, they should not be construed to limit the technological concept disclosed herein by the accompanying drawings, and the concept of the present disclosure should be construed as being extended to all modifications, equivalents, and substitutes included in the concept and technological scope of the invention.

It will be understood that, although the terms first, second, etc. may be used herein to describe various elements, these elements should not be limited by these terms. These terms are only used to distinguish one element from another.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

A singular representation may include a plural representation as far as it represents a definitely different meaning from the context.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, constituent elements, components or combinations thereof are not excluded in advance.

Figure 2:
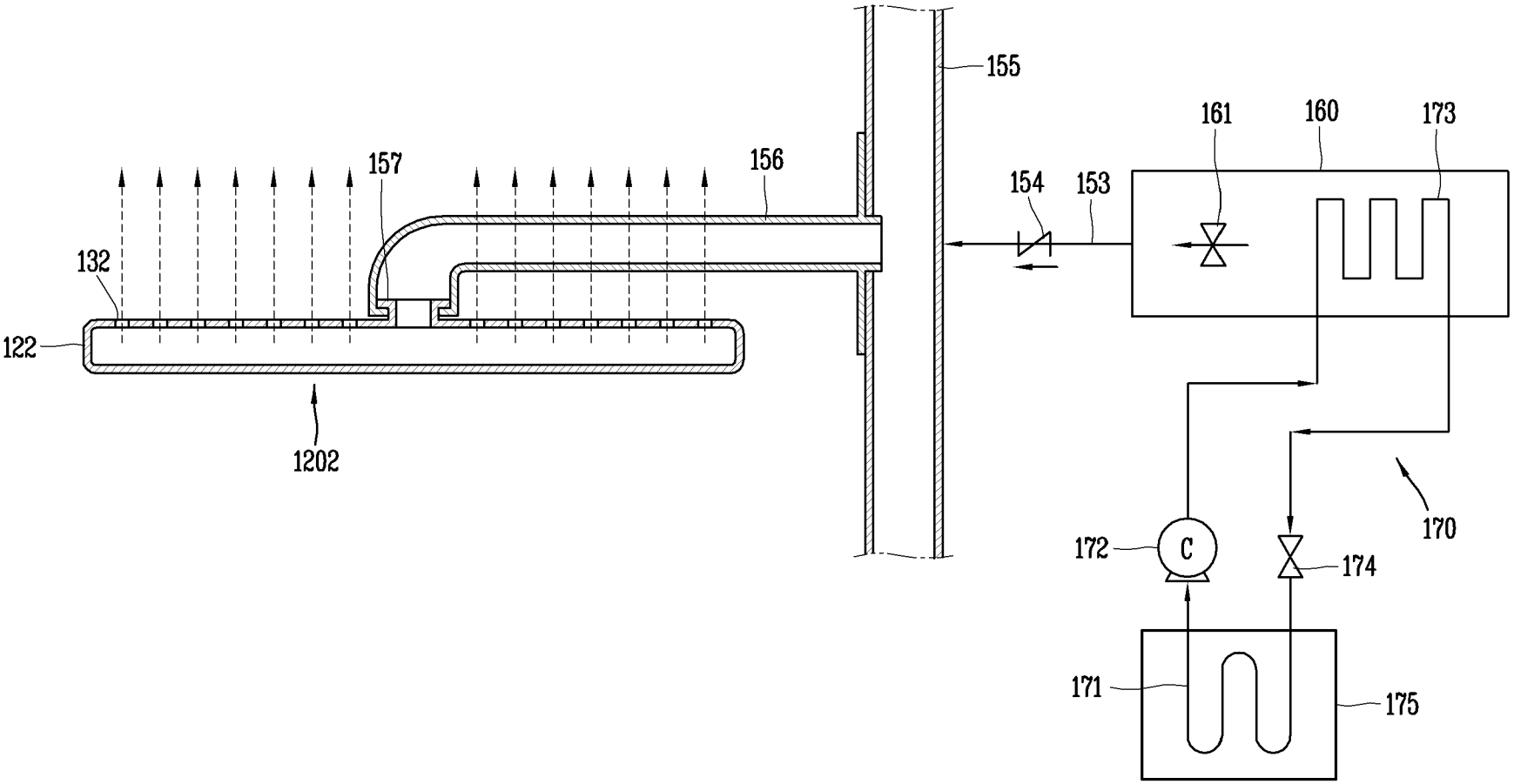
FIG. 2 is a conceptual view showing a state in which hot air is to transferred to an injection arm in FIG. 1.
Figure 3:
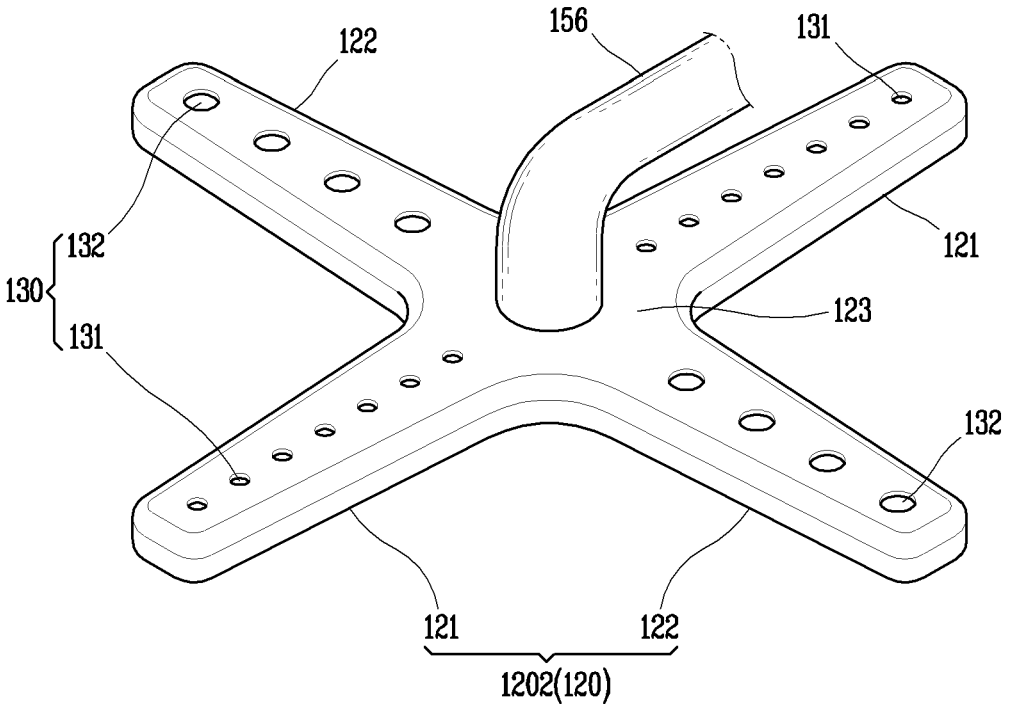
FIG. 3 is a conceptual view showing the injection arm in FIG. 1.
Figure 4:
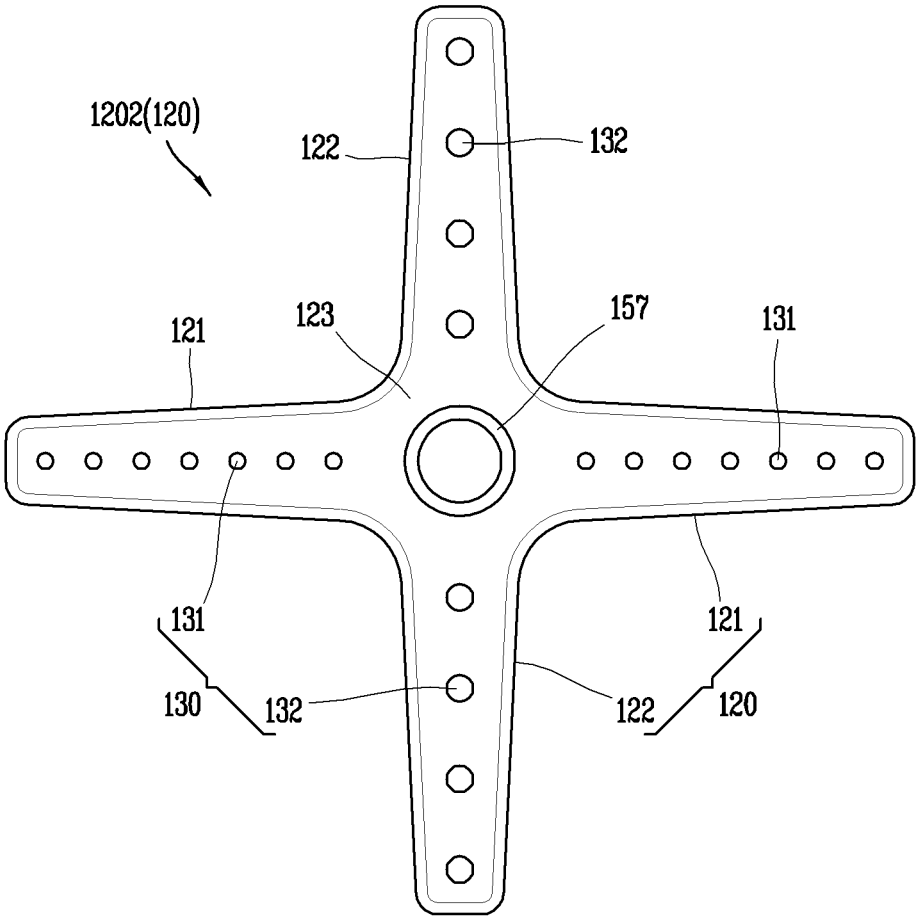
FIG. 4 is a conceptual view showing an example in which the hole sizes of washing water injection nozzles and air injection nozzles are differently defined on the injection arm in FIG. 3.
Figure 5:
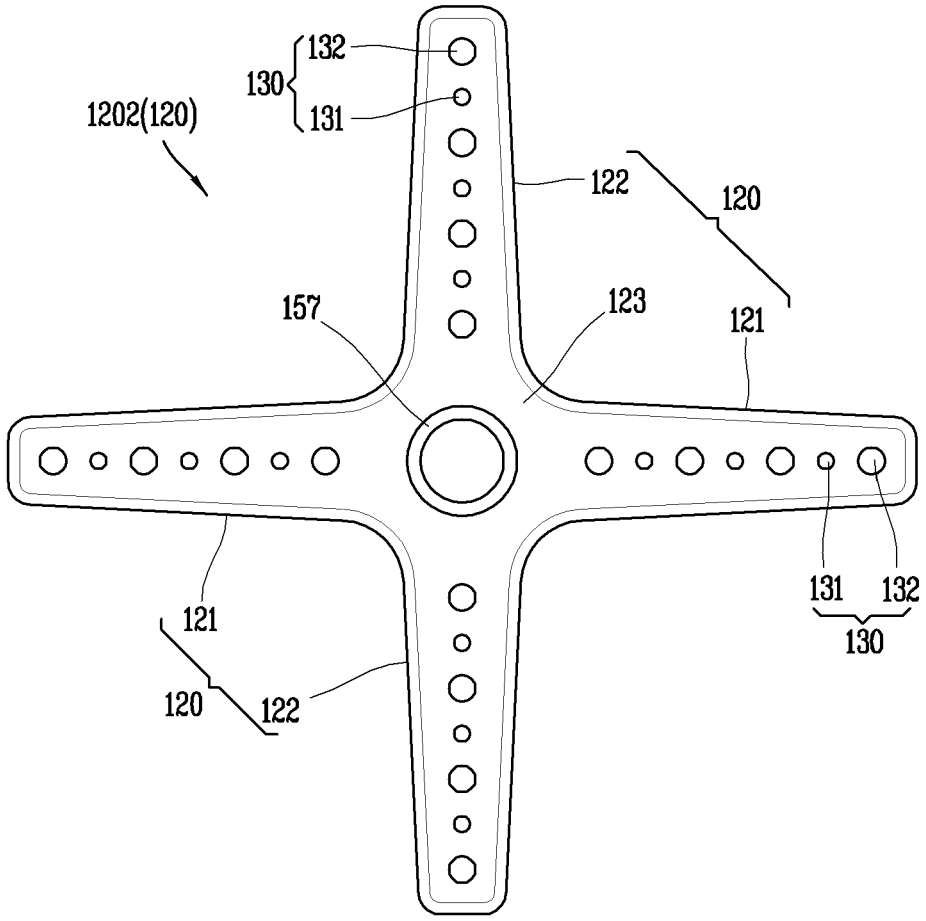
FIG. 5 is a conceptual view showing another example in which the washing water injection nozzles and the air injection nozzles are alternately formed on the injection arm in FIG. 3.

FIG. 1 is a conceptual view showing a dish washer 100 according to a first embodiment of the present disclosure, and FIG. 2 is a conceptual view showing a state in which hot air is transferred to an injection arm 120 in FIG. 1, and FIG. 3 is a concept view showing the injection arm 120 in FIG. 1, and FIG. 4 is a conceptual view showing an example in which the hole sizes of washing water injection nozzles 131 and air injection nozzles 132 are differently defined on the injection arm 120 in FIG. 3, and FIG. 5 is a conceptual view showing another example in which the washing water injection nozzles 131 and the air injection nozzles 132 are alternately formed on the injection arm 120 in FIG. 3.

The dish washer 100 according to the present disclosure may include a cabinet 101, a washing tank 110, an injection arm 120, a duct unit 160, a heat pump system 170, and the like.

The cabinet 101 may define an appearance of the dish washer 100. An accommodation space may be defined in the cabinet 101.

An inlet port is disposed at a front side of the cabinet 101 to put dishes or the like therein.

The inlet port may be opened and closed by a door 102. The door 102 may be rotatably hinge-coupled to a front side of the cabinet 101.

The washing tank 110 may be provided in the cabinet 101. An accommodation space for storing dishes may be disposed inside the washing tank 110. An opening portion may be disposed at a front side of the washing tank 110 to correspond to the inlet port.

A gasket is disposed along a rear edge of the door 102, and the gasket may be configured to seal washing water inside the washing tub 110 from leaking into an the inner space of the cabinet 101.

A sump 113 may be recessed on a bottom surface of the washing tank 110. Washing water may be collected in the sump 113.

A plurality of racks 114 may be provided in the washing tank 110 to put dishes thereon. The plurality of racks 114 may be configured to allow washing water or air to enter and exit the racks 114, and the washing water or air may be injected onto dishes placed on the racks 114.

The plurality of injection arms 120 may be spaced apart in a vertical direction inside the washing tank 110. Each of the plurality of injection arms 120 may include a top injection arm 1201, an upper injection arm 1202, and a lower injection arm 1203.

Each of the plurality of injection arms 120 may extend horizontally. The plurality of injection arms 120 have an internal passage through which washing water or air flows. Each of the plurality of injection arms 120 includes a plurality of nozzles 130.

The plurality of nozzles 130 are configured to inject washing water or air.

A washing water circulation pipe 155 may be configured to connect the sump 113 and the plurality of injection arms 120 to circulate washing water. One side of the washing water circulation pipe 155 is connected in communication with the sump 113, and the other side of the washing water circulation pipe 155 is branched into a plurality of injection arms 120 to be connected in communication with the plurality of injection arms 120.

A three-way valve 158 may be provided at a branch point of the other side of the washing water circulation pipe 155, and washing water may move to at least one or more of the plurality of injection arms 120 through the three-way valve 158.

A circulation pump 159 may be configured to circulate washing water from the sump 113 to the plurality of injection arms 120 along the washing water circulation pipe 155.

The duct unit 160 may be disposed at an upper portion of the washing tank 110. The duct unit 160 may define a passage for the movement of air. One side of the duct unit 160 may be connected in communication with the upper portion of the washing tank 110, and the other side of the duct unit 160 may be connected in communication with the injection arm 120.

A suction port 111 may be disposed at an upper portion of the washing tank 110, and a discharge port 112 may be disposed at one side on a rear surface of the washing tank 110.

An air circulation pipe 150 may include a first air circulation pipe 151 through a third air circulation pipe 153.

The first air circulation pipe 151 may be configured to connect between the suction port 111 of the washing tank 110 and one side (inlet) of the duct unit 160. The second air circulation pipe 152 may be configured to connect between the other side (outlet) of the duct unit 160 and the discharge port 112 of the washing tank 110.

The third air circulation pipe 153 may be configured to connect between the discharge port 112 of the washing tank 110 and the injection arm 120 or connect between the discharge port 112 of the washing tank 110 and the washing water circulation pipe 155. In the present embodiment, the third air circulation pipe 153 is configured to connect between the discharge port 112 and the washing water circulation pipe 155 to move air to the injection arm 120 through the washing water circulation pipe 155.

The second air circulation pipe 152 and the third air circulation pipe 153 may connect between the duct unit 160 and the injection arm 120 to define an air connection passage.

A suction fan 161 may be provided inside the duct unit 160 to suction air inside the washing tank 110 into the duct unit 160. The suction fan 161 may provide circulation power to the air to allow the air to be circulated to the injection arm 120 along the air circulation pipe 150.

An air heating element may be provided inside the duct unit 160. The air heating element may be composed of a heat pump system 170 or an electric heater. The heat pump system 170 and the electric heater may be applied together.

In the present embodiment, a configuration to which the heat pump system 170 is applied.

The heat pump system 170 may include an evaporator 171, a compressor 172, a condenser 173, and an expansion apparatus 174. The evaporator 171 and the condenser 173 may be provided inside the duct unit 160.

The evaporator 171 may be configured to cool moist steam suctioned into the duct unit 160 from an inside of the washing tank 110 to remove moisture.

The condenser 173 may be spaced apart from a downstream side of the evaporator 171 inside the duct part 160 with respect to the air movement direction, and may be configured to heat the dehumidified air.

However, the evaporator 171 may be accommodated in the heat exchange chamber 175 that is not provide in the duct unit 160 but disposed separately from the duct unit 160. Water may be stored inside the heat exchange chamber 175 such that the water may be configured to transfer heat to the evaporator 171 (FIG. 2).

Referring to FIG. 2, the compressor 172 may be configured to compress and circulate refrigerant. The condenser 173 accommodated in the duct unit 160 is configured to condense high-temperature, high-pressure refrigerant from the compressor 172. The refrigerant of the condenser 173 may exchange heat with air suctioned into the duct unit 160 to release heat to the air so as to heat the air.

The expansion apparatus 174 may be configured with a capillary tube or an electronic expansion valve. The expansion apparatus 174 is configured to expand refrigerant received from the condenser 173.

The evaporator 171 accommodated in the heat exchange chamber 175 may exchange heat between low-temperature, low-pressure refrigerant received from the expansion apparatus 174 and water stored in the heat exchange chamber 175 to absorb heat from the water to the refrigerant so as to evaporate the refrigerant.

The refrigerant is configured to release heat from the condenser 173 and absorb heat from the evaporator 171 when repeatedly circulated through the compressor 172, the condenser 173, the expansion apparatus 174 and the evaporator 171.

The air heated by the condenser 173 may move from the duct unit 160 to the washing water circulation pipe 155 along the second air circulation pipe 152 and the third air circulation pipe 153. A non-return valve 154, for example, a check valve, may be provided in the third air circulation pipe 153 to prevent air from flowing back.

The non-return valve 154 allows the movement of air from the air circulation pipe 150 to the washing water circulation pipe 155, but on the contrary, prevents the movement of air from the washing water circulation pipe 155 to the air circulation pipe 150.

A plurality of injection arm connection pipes 156 may be connected between the injection arm 120 and the washing water circulation pipe 155. One side of each of the plurality of injection arm connection pipes 156 may be connected in communication with the washing water circulation pipe 155, and the other side thereof may be connected in communication with the center of the injection arm 120.

Heated air (hot air) may be supplied to an internal passage of the injection arm 120 through the washing water circulation pipe 155 and the injection arm connection pipe 156.

An inlet pipe 157 may be disposed to protrude upward at the center of the injection arm 120, and a flange portion may be disposed at an upper end of the inlet pipe 157.

One end portion of the injection arm connection pipe 156 may be configured to receive and engage with the flange portion of the inlet pipe 157. A bearing may be provided between an inner side surface of the one end portion of the injection arm connection pipe 156 and the flange portion of the inlet pipe 157.

The injection arm 120 may be rotatably mounted at one end portion of the injection arm connection pipe 156, and the bearing may rotatably support the injection arm 120 with respect to the injection arm connection pipe 156.

A plurality of nozzles 130 may be arranged on an upper surface or a lower surface of the injection arm 120.

A plurality of nozzles 130 may be arranged on a lower surface of the top injection arm 1201.

The plurality of nozzles 130 may be arranged on upper and lower surfaces of the upper injection arm 1202, respectively.

The plurality of nozzles 130 may be arranged on an upper surface of the lower injection arm 1203.

The plurality of nozzles 130 may be spaced apart along a length direction of the injection arm 120.

The plurality of nozzles 130 may inject air flowing into the internal passage of the injection arm 120 into dishes.

Referring to FIG. 3, each of the plurality of injection arms 120 may have a cross shape.

The injection arm 120 may be configured with a plurality of first injection arm portions 121, a plurality of second injection arm portions 122, and a central connection portion 123.

The first injection arm portion 121 and the second injection arm portion 122 may extend in directions crossing each other. The plurality of first injection arm portions 121 may be branched from both sides of the central connection portion 123 and may extend radially outward to be disposed on the same line.

A plurality of first nozzles 131 may be arranged on an upper surface of the plurality of first injection arm portions 121. Each of the plurality of first nozzles 131 may pass through a first internal passage of the first injection arm portion 121 in a thickness direction to communicate therewith. Each of the plurality of first nozzles 131 may include an injection hole, and may be configured to inject washing water.

The plurality of second injection arm portions 122 may be respectively branched from different both sides of the central connection portion 123 and may extend radially outward to be arranged on the same line with one another. The second injection arm 122 may be spaced apart from the first injection arm 121 at intervals of 90 degrees in a substantially circumferential direction.

A plurality of second nozzles 132 may be arranged on an upper surface of the plurality of second injection arm portions 122. Each of the plurality of second nozzles 132 may pass through a second internal passage of the second injection arm portion 122 in a thickness direction to communicate therewith. Each of the plurality of second nozzles 132 may include an injection hole, and may be configured to inject air.

The inner end portions of each of the first injection arm portion 121 and the second injection arm portion 122 may be connected to communicated with each other by the central connection portion 123.

Referring to FIG. 4, the first nozzle 131 disposed on the first injection arm 121 and the second nozzle 132 disposed on the second injection arm 122 may have different sizes of injection holes. For example, a hole size of the second nozzle 132 may be larger than that of the first nozzle 131.

According to this configuration, a hole size of the air injection nozzle (second nozzle 132) is larger than that of the washing water injection nozzle (first nozzle 131) to secure more airflow rate, thereby improving the drying performance.

The first injection arm portion 121 may define a washing water passage therein, and the second injection arm portion 122 may define an air passage therein.

Referring to FIG. 5, the first nozzle 131 and the second nozzle 132 may be alternately spaced apart from each other along a length direction of the first injection arm 121. In addition, the first nozzle 131 and the second nozzle 132 may also be alternately spaced apart in a length direction of the second injection arm 122.

The present embodiment is different from the first embodiment in that the first nozzle 131 and the second nozzle 132 are alternately arranged with different hole sizes without discriminating the first injection arm 121 or the second injection arm 122.

The number of second nozzles 132 may be greater than that of the first nozzles 131 to secure more air flow rate.

Figure 6:
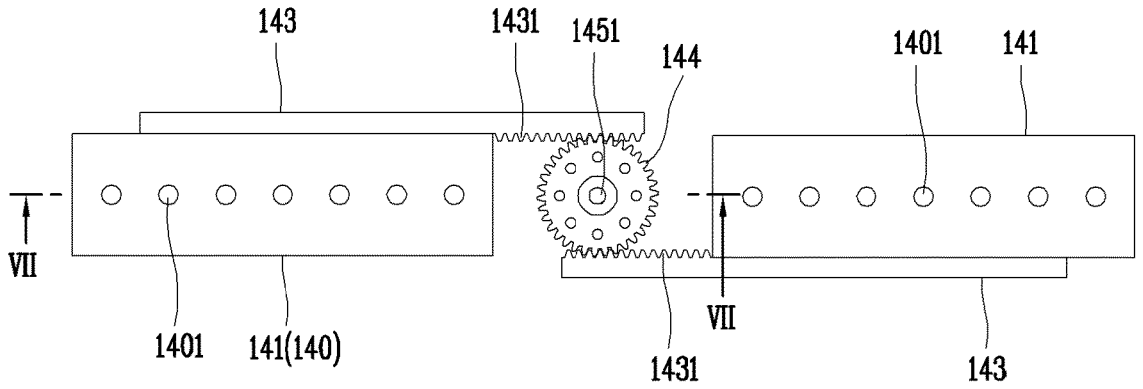
FIG. 6 is a conceptual view showing a nozzle opening and closing portion provided inside an injection arm portion in FIG. 3.
Figure 7:
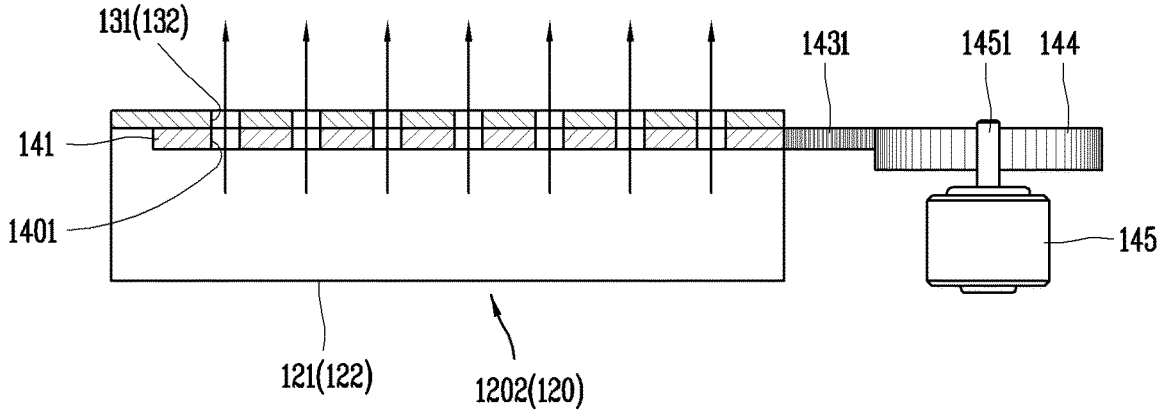
FIG. 7 is a conceptual view showing a state in which the nozzles are opened by operating the nozzle opening and closing portion in FIG. 6.
Figure 8:
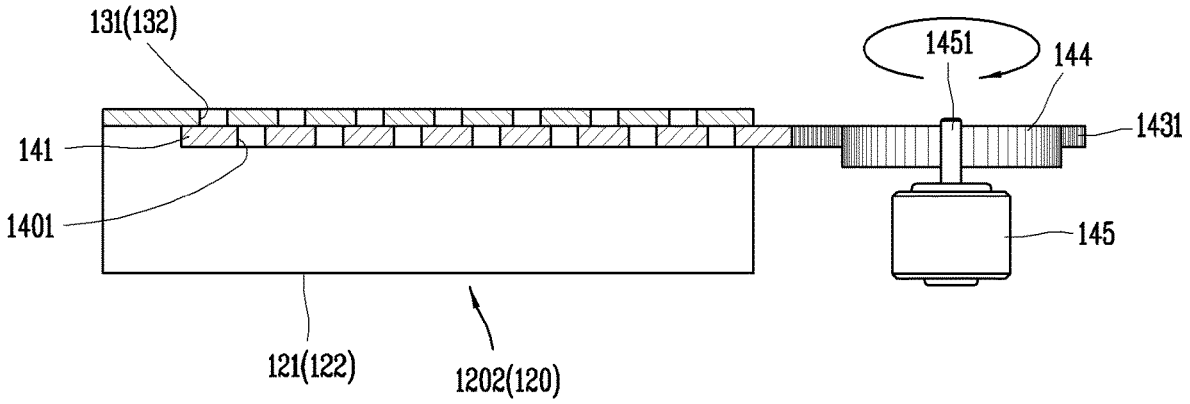
FIG. 8 is a conceptual view showing a state in which the nozzles are closed by operating the nozzle opening and closing portion in FIG. 6.

FIG. 6 is a conceptual view showing a nozzle opening and closing portion 140 provided inside an injection arm portion in FIG. 3, and FIG. 7 is a conceptual view showing a state in which the nozzles 130 are opened by operating the nozzle opening and closing portion 140 in FIG. 6, and FIG. 8 is a conceptual view showing a state in which the nozzles 130 are closed by operating the nozzle opening and closing portion 140 in FIG. 6.

The nozzle opening and closing portion 140 may be provided in each of the plurality of first and second injection arm portions 122. The nozzle opening and closing portion 140 may be disposed in a rectangular plate shape. A plurality of nozzle communication holes 1401 may be arranged in a thickness direction in the nozzle opening and closing portion 140. Each of the plurality of nozzle communication holes 1401 may be disposed to correspond to a hole size of the nozzle 130.

For example, the nozzle opening and closing portion 140 provided in the first injection arm portion 121 may have the same size as the first nozzle 131, and the nozzle opening and closing portion 140 provided in the second injection arm portion 122 may have the same size as the second nozzle 132.

However, in case where both the first nozzle 131 and the second nozzle 132 are included in each of the first injection arm 121 and the second injection arm 122, the nozzle communication holes 1401 may be arranged to correspond to each size of the first nozzle 131 and the second nozzle 132.

The nozzle opening and closing portion 140 may be slidably mounted along a length direction of the injection arm 120.

A linear guide 143 may be integrally disposed at one side of the nozzle opening and closing portion 140. A rack gear 1431 may be disposed at one side of the linear guide 143. The rack gear 1431 may have a shape in which gear teeth are consecutively arranged in a straight direction.

A circular drive gear portion 144 may be disposed to engage with the rack gear 1431. The drive gear portion 144 may be implemented as a circular spur gear. The drive gear portion 144 may be rotatably mounted inside the injection arm portion.

A drive unit 145 may be provided inside the injection arm 120 to rotate the drive gear portion 144. The drive unit 145 may be implemented with a motor. The drive unit 145 may be connected to the drive gear portion 144 through a rotary shaft 1451. When the drive unit 145 is driven, the rack gear 1431 moves in a length direction of the injection arm 120 while rotating the drive gear portion 144 to move the nozzle opening and closing portion 140.

The drive gear portion 144 may be configured to engage with a plurality of nozzle opening and closing portions 140.

For example, a first nozzle opening and closing portion 141 may be disposed inside one of the plurality of first injection arm portions 121, and a second nozzle opening and closing portion 142 may be disposed on the same line as the first nozzle opening and closing portion 141 and may be disposed inside another one of the first injection arm portions 121.

The linear guide 143 disposed at one side surface of the first nozzle opening and closing portion 141 may be coupled to engage with one side of the drive gear portion 144, and the linear guide 143 disposed at the other side surface of the second nozzle opening and closing portion 142 may be coupled to engage with the other side of the drive gear portion 144.

According to this configuration, the first nozzle opening and closing portion 141 and the second nozzle opening and closing portion 142 may move in opposite directions as the drive gear portion 144 rotates.

In other words, the first nozzle opening and closing portion 141 and the second nozzle opening and closing portion 142 may move in a direction away from the drive gear portion 144 or move in a direction closer toward the drive gear portion 144.

Referring to FIG. 7, the first nozzle opening and closing portion 141 may move in one direction, and the first nozzles 131 and the nozzle communication holes 1401 of the first nozzle opening and closing portion 141 may b disposed to coincide with each other to open the first nozzles 131.

Referring to FIG. 8, the first nozzle opening and closing portion 141 may move in a direction opposite thereto, and the first nozzles 131 and the nozzle communication holes 1401 of the first nozzle opening and closing portion 141 may be alternately arranged to close the first nozzles 131.

This may also be applied to the case of the second nozzle opening and closing portion 142 as well.

In addition, the first nozzle opening and closing portion 141 and the second nozzle opening and closing portion 142 may be applied to the plurality of second injection arm portions 122 as well as the plurality of first injection arm portions 121, respectively. However, for the first and second nozzle openings and closing portions 142 provided in each of the plurality of second injection arm portions 122, a size of each of the nozzle communication holes 1401 may be defined to be the same as that of each of the second nozzles 132.

In addition, when the first nozzles 131 and the second nozzles 132 are alternately arranged together in each of the plurality of first injection arm portions 121 or the plurality of second injection arm portions 122, the plurality of nozzle communication holes 1401 may be spaced apart from one another in a size corresponding to each of the first nozzles 131 and the second nozzles 132, only the first nozzles 131 may be opened when the first nozzle opening and closing portion 141 or the second nozzle opening and closing portion 142 moves in one direction, and only the second nozzles 132 may be opened when moves in a direction opposite thereto.

According to this configuration, the first nozzles 131 for washing water and the second nozzles for air, which are arranged to have different hole sizes in the injection arm portion, may be selectively opened and closed according to the washing stroke and the drying stroke, thereby opening the first nozzles 131 to inject washing water to dishes with the injection arm 120 so as to wash the dishes during the washing stroke.

In addition, the second nozzles 132 may be opened to inject heated air to dishes through the injection arm 120 to dry the dishes during the drying stroke.

Moreover, hot air may increase flow rate while passing through the air nozzles (second nozzles) 132 having a larger hole size than the washing water nozzles (first nozzles) 131 131, thereby improving the drying performance.

Besides, as hot air passes through the injection arm 120, the flow rate may increase and hot air may be blown out to dishes at an increased injection pressure through the plurality of nozzles 130, thereby transferring more heat to the dishes more quickly than a drying method by natural convection inside the washing tank 110 in the related art.

In addition, as an air injection pressure of the nozzles 130 increases, the injection arm 120 may obtain momentum by a reaction force against injecting air, thereby rotating the injection arm 120 without the need for a motor or the like.

Besides, as the injection arm 120 rotates, a flow of air may be generated inside the washing tank 110 to maximize the heat exchange performance between dishes and hot air, thereby greatly reducing the drying time of the dishes.

Figure 9:
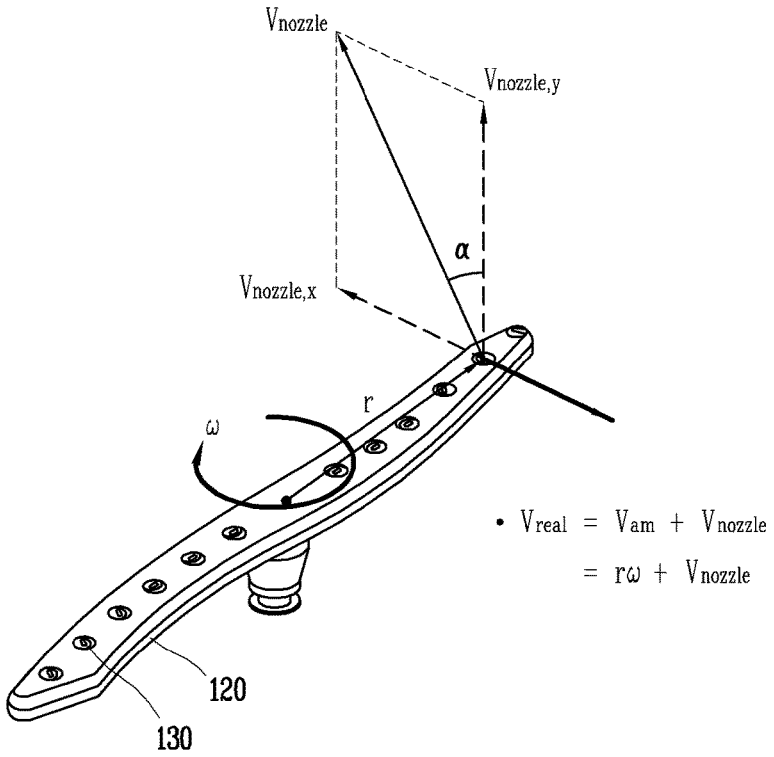
FIG. 9 is a conceptual view for explaining a principle that the injection arm according to the present disclosure rotates by an air injection pressure.
Figure 10:
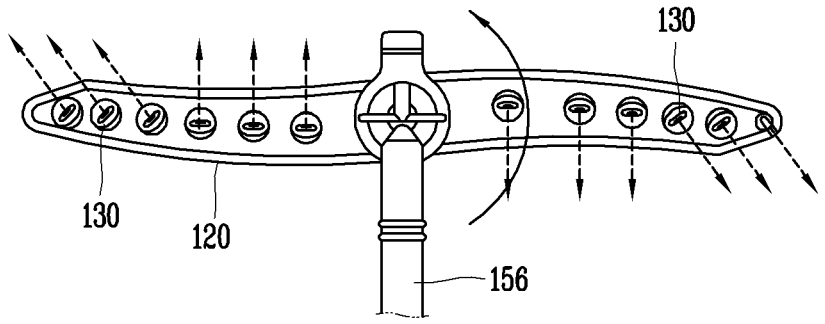
FIG. 10 is a conceptual view showing nozzles arranged in the injection arm according to the present disclosure and an injecting direction thereof.
Figure 11:
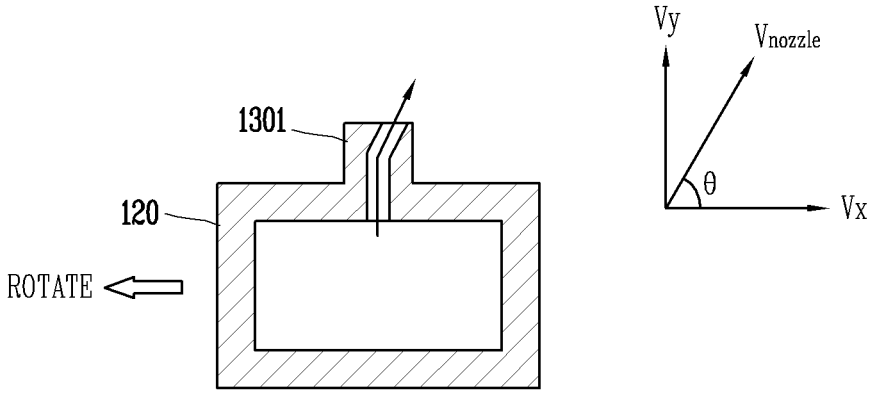
FIG. 11 is a conceptual view showing an injection hole disposed to be inclined in a direction opposite to the rotation of the injection arm in a first nozzle according to a first embodiment, by taking a cross section along line XI-XI in FIG. 10.
Figure 12:
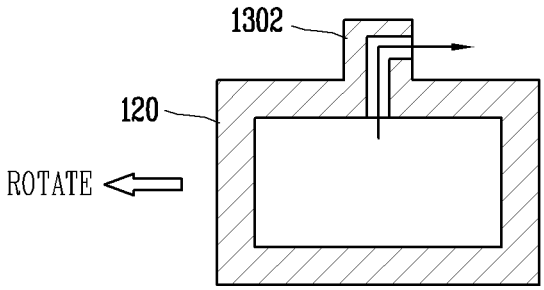
FIG. 12 is a conceptual view showing an injection hole disposed horizontally in a direction opposite to the rotation of the injection arm in a second nozzle according to a second embodiment.
Figure 13:
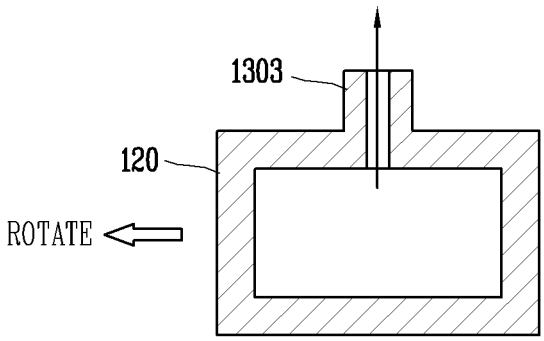
FIG. 13 is a conceptual view showing an injection hole disposed vertically toward dishes in a third nozzle according to a third embodiment.

FIG. 9 is a conceptual view for explaining a principle that the injection arm 120 according to the present disclosure rotates by an air injection pressure, and FIG. 10 is a conceptual view showing nozzles 130 arranged in the injection arm 120 according to the present disclosure and an injecting direction thereof, and FIG. 11 is a conceptual view showing an injection hole disposed to be inclined in a direction opposite to the rotation of the injection arm 120 in a first nozzle 1301 according to a first embodiment, by taking a cross section along line XI-XI in FIG. 10, and FIG. 12 is a conceptual view showing an injection hole disposed horizontally in a direction opposite to the rotation of the injection arm 120 in a second nozzle 1302 according to a second embodiment, and FIG. 13 is a conceptual view showing an injection hole disposed vertically toward dishes in a third nozzle 1303 according to a third embodiment.

Referring to FIG. 9, the plurality of nozzles 130 may be arranged such that injection holes are inclined in a direction opposite to the rotation of the injection arm.

According to this configuration, the injection arm 120 may rotate under momentum by a force (Vnozzle, x) in a direction opposite to the rotation of the injection arm 120, which is an X-axis component of the air injection speed, and a flow rate (Vreal) of air injected through the injection holes of the nozzles 130 during the rotation of the injection arm 120 may be calculated as a sum of a rotational speed (Varm) of the injection arm 120 and an injection speed (Vnozzle) of the nozzles 130.

Therefore, an air flow rate inside the washing tank 110 is increased by a rotational speed of the injection arm 120 more than the injection speed of air injected from the nozzle 130, and thus an air flow inside the washing tank 110 is actively generated to significantly improve the drying performance.

Referring to FIG. 10, the plurality of nozzles 130 may be arranged to have a smaller distance between the nozzles 130 as located away from the center of the injection arm 120.

The plurality of nozzles 130 may be arranged at both end portions around the center of the injection arm 120, respectively, and each of the plurality of nozzles 130 may be disposed in a twisted manner at a predetermined angle with respect to a tangential direction of the circumference along a rotation direction of the injection arm 120.

The plurality of nozzles 130 twisted with respect to the circumference may inject air in a direction crossing the circumference in an oblique direction.

The plurality of nozzles 130 respectively arranged at both end portions around the center of the injection arm 120 are configured to inject air in opposite directions to each other.

According to this configuration, an air flow may be actively generated by increasing a rotational force (torque) due to the injection pressure of air.

Referring to FIGS. 11 through 13, the plurality of nozzles 130 may be arranged such that the injection holes have various injection angles.

For example, the plurality of nozzles 130 may include first nozzles 1301 through third nozzles 1303.

The first nozzle 1301 may be disposed such that the injection hole is inclined upward or downward with respect to a direction opposite to the rotation of the injection arm 120. An inclination angle (θ) of the injection hole may be approximately 30 degrees to 70 degrees with respect to the horizontal plane. The Inclination angle of the injection hole is not limited thereto.

The second nozzle 1302 may have an injection hole horizontally disposed in a direction opposite to the rotation of the injection arm 120. The inclination angle of the injection hole may be zero degrees.

The third nozzle 1303 may have an injection hole perpendicular to a rotation direction or a counter rotation direction of the injection arm 120.

At least one or more of the plurality of first to third nozzles 1303 may be arranged in one injection arm portion.

As an inclination angle of the injection hole of the nozzle 130 approaches zero degrees, the momentum of the injection arm 120 increases to improve a heat transfer efficiency of air due to an air flow, but there is a disadvantage in that an amount of air injected into dishes for dish washing or drying decreases.

As an inclination angle of the injection hole of the nozzle 130 approaches 90 degrees, the momentum of the injection arm 120 decreases to reduce a heat transfer efficiency of air due to an airflow, but there is an advantage in that an amount of air injected into dishes increases.

Therefore, it is preferable that the inclination angle of the injection hole is appropriately defined in the nozzle 130 of each injection arm portion to not only improve the heat transfer efficiency of air due to an air flow but also increase the amount of air injected into dishes.

For example, an inclination angle of the injection holes of the nozzles 130 may increase in a vertical direction as the nozzles 130 are arranged closer to the center of the injection arm 120, and the inclination angle of the injection holes of the nozzles 130 may decrease in a horizontal direction as the nozzles 130 are arranged away from the center of the injection arm 120, thereby improving the heat transfer efficiency due to an air flow as well as increasing an amount of air injected to dishes to reduce the drying time.

In the first embodiment, an electric heater may be provided in place of the evaporator 171 and the condenser 173 provided inside the duct unit 160, or the electric heater may be additionally provided at a downstream side of the condenser 173.

Figure 14:
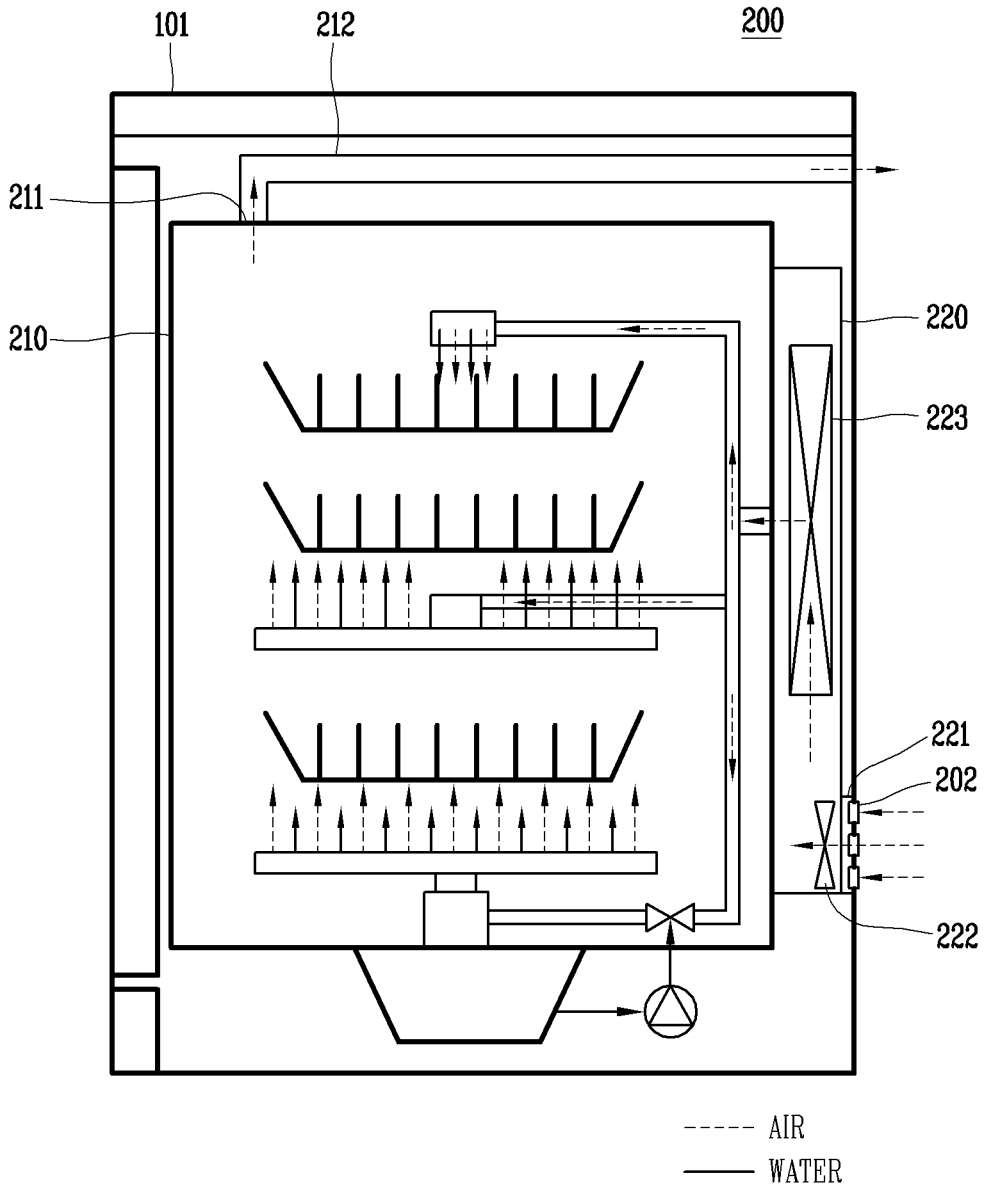
FIG. 14 is a conceptual view showing a dish washer according to a second embodiment of the present disclosure.

FIG. 14 is a conceptual view showing a dish washer 200 according to a second embodiment of the present disclosure.

The present embodiment is a discharge type in which outside air is suctioned into the washing tank 210, and dishes are dried with heated air and the air is discharged to the outside, and it is different from a circulation type of the first embodiment.

For example, an outside air inlet port 202 may be disposed at a rear surface of the cabinet 201 to allow outside air to flow into the cabinet 201.

The duct unit 220 may be provided on a rear surface of the washing tank 210. A suction port 221 may be disposed at a lower portion of the duct unit 220, and a suction fan 222 may be provided in the suction port 221 to suction outside air flowing in through the outside air inlet port 202 into the duct unit 220 through the suction port 221.

An electric heater 223 may be provided inside the duct unit 220 to heat the air suctioned through the suction fan 222.

The heated air may be injected into the washing water circulation pipe through an air injection pipe 224 connected to the washing water circulation pipe. One side of the air injection pipe 224 may be connected in communication with the duct unit 220 through a through hole disposed on a rear surface of the washing tank 210. The other side of the air injection pipe 224 may be connected in communication with the washing water circulation pipe.

Instead of the electric heater 223, the condenser of the heat pump system may be provided inside the duct unit 220, or the condenser and the electric heater 223 may be provided in the duct unit 220.

An exhaust port 211 may be disposed at an upper portion of the washing tank 210. The air of the washing tank may be discharged to the outside through the exhaust passage 212. One side of the exhaust duct 212 may be connected in communication with the exhaust port 211, and the other side of the exhaust duct 212 may be connected in communication with the outside of the cabinet 201.

The evaporator 171 may be provided inside the exhaust duct 212, and air heated in the washing tank 210 may be cooled while passing through the evaporator 171 and then discharged to the outside.

What is claimed is:

1. A dish washer, comprising:

a washing tank that defines an accommodation space therein configured to receive one or more objects to be washed;

an injection arm disposed inside the washing tank, the injection arm comprising a plurality of nozzles configured to selectively inject washing water or air to the one or more objects according to an operation process of the dish washer, the operation process comprising a washing operation and a drying operation;

a duct unit that defines a passage configured to guide air to the injection arm;

a suction fan disposed inside the duct unit and configured to generate air flow in the duct unit and supply air to the injection arm; and an air heating element configured to heat air to thereby supply heated air to the injection arm, wherein the injection arm is connected to and in communication with the duct unit to thereby receive air from the duct unit, the injection arm being configured to inject the air received from the duct unit onto the one or more objects during the drying operation.

2. The dish washer of claim 1, wherein the plurality of nozzles comprise a first nozzle configured to discharge washing water and a second nozzle configured to discharge air, and wherein the first nozzle and the second nozzle have different hole sizes.

3. The dish washer of claim 1, wherein the plurality of nozzles comprise:

a plurality of first nozzles configured to inject washing water during the washing operation; and a plurality of second nozzles configured to inject air during the drying operation.

4. The dish washer of claim 3, wherein a hole size of each of the plurality of second nozzles is greater than a hole size of each of the plurality of first nozzles.

5. The dish washer of claim 3, wherein the plurality of first nozzles and the plurality of second nozzles are alternately arranged along a length direction of the injection arm.

6. The dish washer of claim 3, wherein the injection arm comprises:

an injection arm body that defines the plurality of nozzles;

a nozzle opening and closing portion that defines a plurality of nozzle communication holes, that is disposed inside the injection arm body, and that is configured to move relative to the injection arm body, the nozzle opening and closing portion being configured to, based on moving relative to the injection arm body, selectively connect the plurality of nozzles with the plurality of nozzle communication holes;

a drive unit configured to drive the nozzle opening and closing portion to move relative to the injection arm body; and a power transmission unit connected to the drive unit and configured to transmit power received from the drive unit to the nozzle opening and closing portion.

7. The dish washer of claim 6, wherein the power transmission unit comprises:

a drive gear portion connected to the drive unit and configured to receive power of the drive unit and transmit power of the drive unit to the nozzle opening and closing portion; and a linear guide disposed at one side of the nozzle opening and closing portion, the linear guide comprising a rack gear disposed at a side of the linear guide and configured to engage with the drive gear portion to thereby move the nozzle opening and closing portion based on rotation of the drive gear portion, and wherein the nozzle opening and closing portion is configured to, based on movement of the linear guide, selectively overlap the nozzle communication holes with the plurality of nozzles, respectively, in a thickness direction of the injection arm.

8. The dish washer of claim 6, wherein the nozzle opening and closing portion is configured to selectively open and close the plurality of first nozzles and the plurality of second nozzles according to the washing operation and the drying operation.

9. The dish washer of claim 3, wherein the injection arm comprises:

a plurality of first injection arm portions that define the plurality of first nozzles spaced apart in a first length direction of the injection arm and a first inner passage communicating with the plurality of first nozzles;

a plurality of second injection arm portions that define the plurality of second nozzles spaced apart in a second length direction of the injection arm and a second internal passage communicating with the plurality of second nozzles; and a central connection portion that connects first inner end portions of the plurality of first injection arm portions to second inner end portions of the plurality of second injection arm portions.

10. The dish washer of claim 1, further comprising:

a water circulation passage configured to guide washing water to the injection arm; and an air circulation passage that connects the duct unit to the water circulation passage and that is configured to guide air to the injection arm through at least a portion of the water circulation passage.

11. The dish washer of claim 10, further comprising:

a non-return valve disposed at a connection portion between the water circulation passage and the air circulation passage.

12. The dish washer of claim 10, further comprising:

an injection arm connection pipe having a first side that is connected to and in communication with a central portion of the injection arm and a second side that is connected to and in communication with the water circulation passage, wherein the injection arm connection pipe is configured to supply, to the injection arm, washing water or air received through the water circulation passage.

13. The dish washer of claim 1, wherein the injection arm comprises a plurality of injection arms disposed inside the washing tank and spaced apart from each other in a vertical direction.

14. The dish washer of claim 13, wherein each of the plurality of injection arms is rotatably mounted in the washing tank and configured to be rotated by an injection pressure of washing water or air.

15. The dish washer of claim 1, wherein the air heating element comprises a heat pump system comprising:

a compressor configured to circulate refrigerant;

a condenser disposed inside the duct unit and configured to discharge heat of refrigerant compressed in the compressor to air in the duct unit;

an expansion apparatus configured to expand refrigerant condensed in the condenser; and an evaporator configured to evaporate refrigerant received from the expansion apparatus and to transfer refrigerant to the compressor.

16. The dish washer of claim 15, further comprising:

a heat exchange chamber that accommodates the evaporator, that accommodates water therein, and that is configured to exchange heat between the evaporator and water accommodated therein.

17. The dish washer of claim 15, further comprising:

a controller configured to control operation of the condenser, wherein the controller is configured to operate the heat pump system during the washing operation to preheat air prior to the drying operation.

18. The dish washer of claim 1, wherein the air heating element comprises an electric heater disposed inside the duct unit.

19. The dish washer of claim 1, wherein the air heating element comprises:

a condenser disposed inside the duct unit and configured to heat air inside the duct unit; and an electric heater disposed inside the duct unit and configured to further heat air that is heated by the condenser.

20. The dish washer of claim 1, wherein the duct unit is disposed vertically above the washing tank, and wherein the dish washer further comprises:

a suction port disposed at an upper portion of the washing tank and configured to discharge air inside the washing tank; and an air circulation pipe that connects the suction port to the duct unit and that is configured to supply air received from the suction port to a portion of the washing tank disposed vertically below the duct unit.

* * * * *